US010059556B2

(12) United States Patent
Geels et al.

(10) Patent No.: US 10,059,556 B2
(45) Date of Patent: Aug. 28, 2018

(54) METHOD FOR MARKING A PLURALITY OF SHEETS

(71) Applicant: OCE-TECHNOLOGIES B.V., Venlo (NL)

(72) Inventors: Jan H. Geels, Venlo (NL); Ernst P. Van Horssen, Venlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 74 days.

(21) Appl. No.: 15/277,671

(22) Filed: Sep. 27, 2016

(65) Prior Publication Data

US 2017/0015517 A1 Jan. 19, 2017

Related U.S. Application Data

(63) Continuation of application No. PCT/EP2015/057461, filed on Apr. 7, 2015.

(30) Foreign Application Priority Data

Apr. 10, 2014 (EP) ..... 14164255

(51) Int. Cl.
*B65H 43/00* (2006.01)
*B65H 5/34* (2006.01)
(Continued)

(52) U.S. Cl.
CPC ..... *B65H 43/00* (2013.01); *B41J 13/0045* (2013.01); *B65H 37/06* (2013.01);
(Continued)

(58) Field of Classification Search
CPC ..... B26D 5/34; B65H 43/00
See application file for complete search history.

(56) References Cited

U.S. PATENT DOCUMENTS 5,085,417 A 2/1992 Copham
2005/0286915 A1 12/2005 Butikofer

FOREIGN PATENT DOCUMENTS

EP 1 703 320 A1 9/2006
JP 6-143862 A 5/1994
(Continued)

OTHER PUBLICATIONS

JPO Machine translation of Kojima et al., JP 2001-047771 A, Feb. 20, 2001.*
(Continued)

*Primary Examiner* — Jennifer Simmons
(74) *Attorney, Agent, or Firm* — Birch, Stewart, Kolasch & Birch, LLP

(57) ABSTRACT

A system and a method for automatically processing a plurality of sheets. The method includes receiving printing instructions, receiving finishing instructions, after printing, in order to form a stack of printed and finished sheets, the finishing instructions includes an instruction to create a new target stack edge extending in a direction of a stack height on each of the plurality of sheets, printing a mark on each sheet of a group of sheets of the plurality of sheets, the mark intended to hit the new target stack edge in a group of at least one target hit point, and finishing the plurality of printed sheets according to the finishing instructions to create a new actual stack edge. A plurality of actual hit points form a pattern on the new actual stack edge and comprises a continuous proportional indication for a degree of correctness of the printing and/or finishing operation.

16 Claims, 10 Drawing Sheets

(51) Int. Cl.

| | |
|---|---|
| ***G03G 15/00*** | (2006.01) |
| ***B41J 13/00*** | (2006.01) |
| ***B65H 37/06*** | (2006.01) |
| ***B65H 39/10*** | (2006.01) |

(52) U.S. Cl.
CPC ..... *B65H 39/10* (2013.01); *G03G 15/6582* (2013.01); *G03G 2215/00814* (2013.01); *G03G 2215/00818* (2013.01); *G03G 2215/00902* (2013.01)

(56) References Cited

FOREIGN PATENT DOCUMENTS

| | | | |
|---|---|---|---|
| JP | 2001-47771 | A | 2/2001 |
| JP | 2003-175491 | A | 6/2003 |
| WO | WO 2010/008331 | A1 | 1/2010 |

OTHER PUBLICATIONS

JPO Machine translation of Ishiwatari et al., JP 2003175491 A, Jun. 24, 2003.*

* cited by examiner

METHOD FOR MARKING A PLURALITY OF SHEETS

CROSS-REFERENCE TO RELATED APPLICATIONS

This application is a Continuation of International Application No. PCT/EP2015/057461, filed on Apr. 7, 2015, and for which priority is claimed under 35 U.S.C. § 120. PCT/EP2015/057461 claims priority under 35 U.S.C. § 119(a) to Application No. 14164255.3, filed in Europe on Apr. 10, 2014. The entire contents of each of the above-identified applications are hereby incorporated by reference into the present application.

BACKGROUND OF THE INVENTION

1. Field of the Invention

The present invention relates to a method for automatically processing a plurality of sheets by means of printing and finishing on a printing system, the method comprising the steps of receiving printing instructions for printing the plurality of sheets, and receiving finishing instructions for finishing the plurality of sheets after printing in order to form a stack of printed and finished sheets, the stack having a stack height. The finishing instructions comprise an instruction to create a new target stack edge extending in a direction of the stack height at an intended position on each of the plurality of sheets, printing a mark on each sheet of a group of sheets out of the plurality of sheets, the mark intended to hit the new target stack edge in a group of at least one target hit point, and finishing the plurality of printed sheets according to the finishing instructions by creating a new actual stack edge. A target hit point is an intended intersection point of the mark with the new target stack edge. The new target stack edge may be an end grain of the stack.

The present invention further relates to a printing system configured to perform the method according to the present invention.

2. Description of the Background Art

A printing system may comprise a print engine for printing images on the plurality of sheets and a finishing module, in-line or off-line, for finishing the plurality of printed sheets. The plurality of printed sheets may form a stack of printed sheets of a certain height defined as the stack height. The plurality of printed sheets may also be offered to the finishing module in order to form a stack of printed sheets, which are then ready to be finished. The finishing instructions may be transferred from a control unit of the printing system to the finishing module directly, or via the print engine. The finishing module may be configured to trim the stack of printed sheets, to cut the stack of printed sheets, to drill the stack of printed sheets, to punch the stack of printed sheets, or to fold the stack of sheets. A trimming operation splits the stack into a part, which is waste, and a part, which is an end product or which is usable for further finishing operations. A cutting operation splits the stack into two parts, which are both usable for an end product or for a further finishing operation. The cutting operation may be performed using a die. A drilling operation creates a hole in the stack in the direction of the stack height, and a punching operation does the same. The created hole may have a circular circumference, or a rectangular circumference, or any other geometrical form. The trimming operation creates at least one new edge, including an edge at the place in the stack where the trimming actually happens, i.e. where a trim knife cuts the stack. The cutting operation creates at least one new edge, including an edge at the place where the stack is divided into at least two parts.

A drilling operation or a punching operation creates a new edge at the inside area of the hole, which may have a circular, rectangular or other geometrically shaped cross-section.

Trimming marks are known, which are printed on a sheet, to indicate the intended location of the trimming line. Cutting marks are known, which are printed on a sheet, to indicate the intended location of the cutting line. When the sheet has been trimmed or cut, the presence of the mark on an inner area of the trimmed or cut sheet indicates that the trimming or cutting was not at the right location. The presence of the mark on the edge of the trimmed or cut sheet indicates that the trimming or cutting was successful, and the absence of the mark on trimmed or cut sheet indicates that the trimming or cutting was also not at the right location. Usually the sheet at the top of the stack is well examined with respect to the marks. However, if a stack has a substantial stack height, a plurality of sheets needs to be examined and taken out of the stack. For example, a deviation or drift of a knife for cutting or trimming when the knife travels down through the stack may give rise to a different trimming or cutting behavior at the top sheets of the stack than at the bottom sheets of the stack.

Printing systems are known to print calibration marks on a top face of a sheet and a bottom face of the sheet, in order to correct for image-sheet registration, front-back registration and color correctness. Printing systems are also known to print cut or trim marks on a top sheet and/or a bottom sheet, to assist a process by a trimming device or a cutting device of the printing system, after printing the plurality of sheets by a print engine of the printing system. However, to produce a correctly finished end product, a trail-and-error method is usually applied, leading to a waste of sheets.

SUMMARY OF THE INVENTION

It is an objective of the present invention to provide a method for producing a correctly finished stack of sheets in a more efficient way.

According to the present invention, a plurality of actual hit points of the plurality of marks, each of the plurality of actual hit point hitting the new actual stack edge and corresponding to one hit point out of the group of at least one target hit point, form a pattern on the new actual stack edge, the pattern extending in a direction of the stack height and comprising a continuous proportional indication for a degree of correctness of the printing on the plurality of sheets and/or the finishing of the plurality of printed sheets. An actual hit point is an intersection point of the mark with the new actual stack edge. An actual hit point is at a location where the mark is intersected by the finishing action, i.e. a piercing action like cutting, trimming, drilling, punching etc. The pattern formed on the new actual stack edge is a visual pattern.

By observing and measuring the pattern it may be determined if and how much the finishing operation deviates from a norm of finishing and if and how the printing operation deviates from a norm for printing. The marks may be located at a midpoint of the new target stack edge and/or near an endpoint of the new target stack edge, when trimming or cutting is the finishing operation. In case of a non-linear new target stack edge, when drilling or punching a hole, the marks may be distributed along the non-linear new target stack edge. A non-linear new target stack edge may have a circular shape.

According to an embodiment, the continuous proportional indication is a group of colors in the pattern, the colors differing with the distance from an actual hit point of the plurality of actual hit points to the corresponding target hit point. Parts of the pattern may be red, orange and green, respectively, in order to indicate an incorrect, a risky and a correct printing and/or finishing of the stack of sheets at the location at which the color emerges on the new actual stack edge. Other colors than red, orange and green may be envisioned.

According to an embodiment, the continuous proportional indication is provided by a size of each of an intersection between the mark and the new actual stack edge. The larger the intersection between the mark and the new actual stack edge, the larger the mistake in printing/finishing of the stack of sheets at the location on the new actual stack edge at which location the pattern emerges. In other words the size of the intersection is proportional to the magnitude of the mistake.

According to an embodiment, the intersection is a line segment and the size of the intersection is determined to be the length of the line segment. The mark on each sheet may, for example, contain a plurality of solid triangles. The intersection of a solid triangle with the new actual stack edge may be a point or a line segment. The length of the line segment indicates a degree of correctness of printing and for finishing of the stack of sheets at the location at which the line segment emerges. The pattern formed by all the intersections on the new actual stack edge may be a solid rectangle, or a solid triangle, or any other compact solid geometrical object.

According to an embodiment, the intersection comprises one point or at least two points, wherein the size is determined to be zero if the intersection consists of one point, and the size is determined to be the largest distance between the at least two points if the intersection comprises at least two points. An intersection may be achieved by printing marks which comprise at least two lines intersecting on the new target stack edge at one point. If the finishing and/or printing is correct, only one point will be visible on each sheet at the new actual stack edge, and the pattern on the new actual stack edge will be a line or any other curve in a direction from the top of the stack of sheets to the bottom of the stack of sheets. If the finishing and/or printing is incorrect, at least two points will be visible on each sheet at the new actual stack edge, and the pattern on the new actual stack edge will be at least two lines or at least two other curves in a direction from the top of the stack of sheets to the bottom of the stack of sheets.

According to a further embodiment, in case of a trimming operation or a cutting operation, two points will be visible on each sheet at the new actual stack edge, and the pattern on the new actual stack edge will be a pair of lines or a pair of other curves in a direction from the top of the stack of sheets to the bottom of the stack of sheets, if the trimming or cutting is too little. Three points will be visible on each sheet at the new actual stack edge, and the pattern on the new actual stack edge will be a trio of lines or a trio of other curves in a direction from the top of the stack of sheets to the bottom of the stack of sheets, if the trimming or cutting is too much.

According to an embodiment, the mark comprises a first part and a second part, each part intersecting the new target stack edge, and the first part and the second part are divergent to each other and to a virtual auxiliary line between the first part and the second part, the virtual auxiliary line being perpendicular to the new target stack edge, and the continuous proportional indication is determined by a distance between an actual hit point of the first part and an actual hit point of the second part at each sheet printed with the mark. For example, the mark may comprise two crossing lines at the new target stack edge. The first part of the mark may be a part of the two crossing lines on one side of the new target stack edge. The second part of the mark may be a part of the two crossing lines on the other side of the new target stack edge.

According to an embodiment, the method further comprises the step of printing a line segment on each sheet of the group of sheets for each target hit point on the sheet, which line segment is part of the new target stack edge and comprises the corresponding target hit point. Such a line segment is an auxiliary line segment for indicating the targeted location of the new target stack edge.

According to an embodiment, the finishing instruction is at least one out of a trimming instruction, a cutting instruction, a drilling instruction, a punching instruction and a folding instruction. The trimming and cutting instruction may lead to a new actual stack edge which has the form of a solid rectangle. The drilling or punching instructions may lead to a new actual stack edge which has the form of an inner side of a cylinder or rectangular box. The folding instruction may lead to a new actual stack edge which is located at the fold line.

According to an embodiment, the finishing instruction comprises a folding instruction for the plurality of sheets along a fold line such that the new target stack edge is intended to be created opposite to the fold line after folding. When a plurality of sheets is folded in half with the intention to create halves of equal size, the stack edge of the stack of sheets opposite to the fold line has a form which is not perfectly a straight rectangle in the direction of the stack height. Such a stack edge has a creep to be compensated for. After folding, such an edge may be trimmed in order to get a straight edge. The trimming operation may for example lead to a smaller margin of printed text on the sheets in the middle of the stack than on the top and bottom of the stack on the side of such an edge.

According to an embodiment, the mark is at least one out of a line segment, a circle, a circle segment, a curve, an ellipse, an ellipse segment, a rectangle, a rectangle corner, a triangle and a group of intersecting line segments. Intersecting line segments may each be positioned towards the new target stack edge in an intersection angle which is lower than $\frac{1}{4}\pi$ radians to achieve a deviation magnifying effect. Such a deviation magnifying effect may also be achieved by using an exponential curve.

According to an embodiment, the pattern consists of one line segment in the stack height direction of the new actual stack edge, if the stack is correctly finished, and comprises at least two line segments in the height direction of the new actual stack edge, if the stack is not correctly finished. This pattern may be achieved by using intersecting line segments or intersecting curves in the marks. According to a further embodiment, in case of a trimming operation or a cutting operation, the pattern on the new actual stack edge will be a pair of lines or a pair of other curves in a direction from the top of the stack of sheets to the bottom of the stack of sheets, if the trimming or cutting is too little. The pattern on the new actual stack edge will be a trio of lines or a trio of other curves in a direction from the top of the stack of sheets to the bottom of the stack of sheets, if the trimming or cutting is too much.

According to an embodiment, the pattern comprises textual or color information of the degree of correctness of printing and/or finishing. The textual or color information may be part of the marks printed on the plurality of sheets. The textual or color information may be located in a mark at such a location that the finishing operation does not mangle the part of the textual or color information, which part is relevant for establishing the degree of deviation from correct printing and/or finishing.

According to a further embodiment, the method comprises steps of receiving the textual or color information by a user interface of the printing system, reading the textual or color information from the stack of sheets, and adapting the printing instructions and/or finishing instructions according to the textual or color information. Textual information may be input via the user interface of the printing system together with a location indication of the location of the textual information on the new actual stack edge. The textual information and the location information are inputs for adaptations of the printing instructions and/or the finishing instructions in a control unit of the printing system.

According to an embodiment, the method comprises the step of receiving a digital image of the pattern at an information interface of the printing system, and mapping the digital image to adaptations to the printing instructions and/or the finishing instructions in order to avoid an incorrect printing and/or finishing. The digital image may be a result of taking a picture of the pattern on the new actual stack edge and inputting the digital image into storage of the printing system for further investigation and analysis. An image processing unit of the printing system may derive adaptations to the printing and/or finishing instructions from the digital image in order to achieve a more correct end product.

The invention further relates to a printing system for automatically printing and finishing a plurality of sheets, the printing system comprises a print engine, a finishing module and a control unit for receiving printing instructions for printing the plurality of sheets and for receiving finishing instructions for finishing the plurality of sheets after printing in order to form a stack of printed and finished sheets. The stack having a stack height, the finishing instructions comprising an instruction to create a new target stack edge extending in a direction of the stack height at an intended position on each of the plurality of sheets, the print engine configured to print a mark on each sheet of a group of sheets out of the plurality of sheets, the mark intended to hit the new target stack edge in a group of at least one target hit point, and the finishing module being configured to finish the plurality of printed sheets according to the finishing instructions creating a new actual stack edge. Wherein a plurality of actual hit points of the plurality of marks, each of the plurality of actual hit points hitting the new actual stack edge and corresponding to one hit point out of the group of at least one target hit point, form a pattern on the new actual stack edge. The pattern extends in a direction of the stack height and comprises a continuous proportional indication for a degree of correctness of the printing on the plurality of sheets and/or the finishing of the plurality of printed sheets.

According to an embodiment of the printing system, the finishing module comprises at least one out of a trimming device, a cutting device, a drilling device, a punching device and a folding device. The finishing module may be situated inside the print engine or off-line from the print engine. In case of off-line finishing, the finishing instructions will go directly to the finishing module.

The invention also relates to a recording medium comprising computer executable program code configured to instruct at least one computer to perform the method according to the present invention.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

DETAILED DESCRIPTION OF THE PREFERRED EMBODIMENTS

Figure 1:
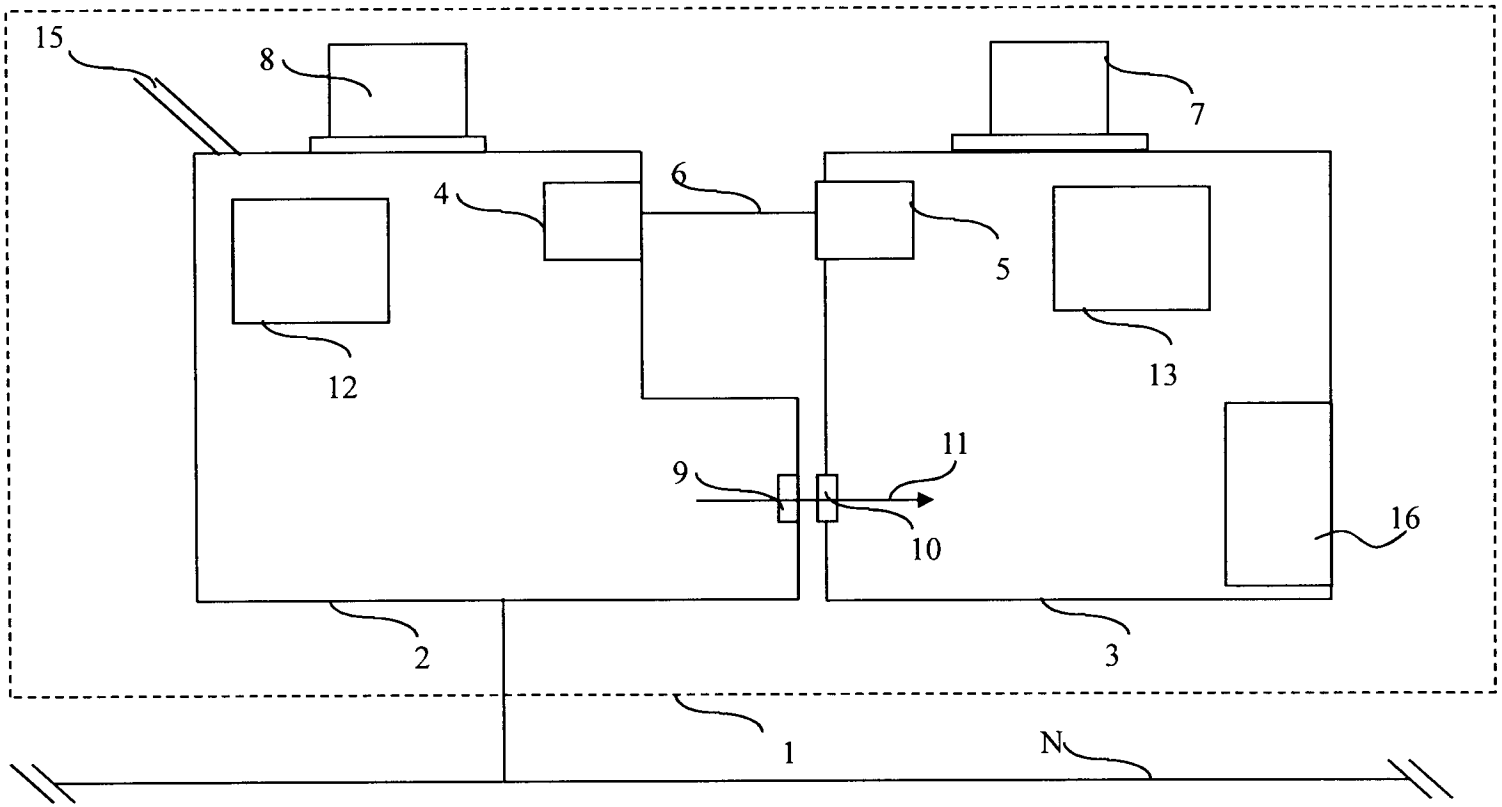
FIG. 1 shows a schematic view of a printing system according to present the invention.

The present invention will now be described with reference to the accompanying drawings, wherein the same or similar elements are identified with the same reference numerals throughout the several views.

FIG. 1 is a first schematic view of a printing system 1 according to the present invention. The view is showing the printing system 1 comprising a print module 2, connected to a network N, a finishing module 3, a print interface 4 in the print module 2, a finishing interface 5 in the finishing module 3, a data connection 6 between the print interface 4 and the finishing interface 5, a finishing module console 7, a print module console 8, a sheet outlet 9, a sheet inlet 10, a printer memory 12 in the print module 2, a finisher memory 13 in the finishing module 3, an automatic document feeder 15 on the print module 2 and an output holder 16 on the finishing module 3 for receiving and holding output of a plurality of sheets, for example a stack of printed and finished sheets. The print interface 4 and the finishing interface 5 are configured to exchange digital information about printing and finishing instructions, which printing and finishing instructions are needed for an errorless printing process, an errorless flow of sheets from the print module towards the finishing module and an errorless finishing process.

The printing and finishing instructions may be part of specifications of a print job received via the network N by the print module 2. Printing and finishing instructions may also be entered via print module console 8 and stored in the printer memory 12 of the print module 2. Finishing instructions may also be entered via finishing module console 7 and stored in the finisher memory 13 of the finishing module 3.

Digital information may be passed from the print module 2 via the printing module interface 4, the data connection 6 and the finishing module interface 5 to the finishing module 3. The data connection 6 may be a communication cable, a wireless connection, infrared beams or any other data communication means. Before the plurality of sheets is printed by the print module 2, the digital information comprising print data, printing instructions and finishing instructions is taken into account when the printing of the plurality of sheets is starting. A printed sheet arrives at the sheet outlet 9 in order to enter the finishing module 3 via the sheet inlet 10, the sheet flow direction indicated by arrow 11. The finishing of the plurality of printed sheets takes into account the finishing instructions which have been passes to the finishing module 3.

The finishing module 3 may be a trimming device, a cutting device, a drilling device, a punching device, a folding device or a combination of before-mentioned finishing devices.

Figure 2:
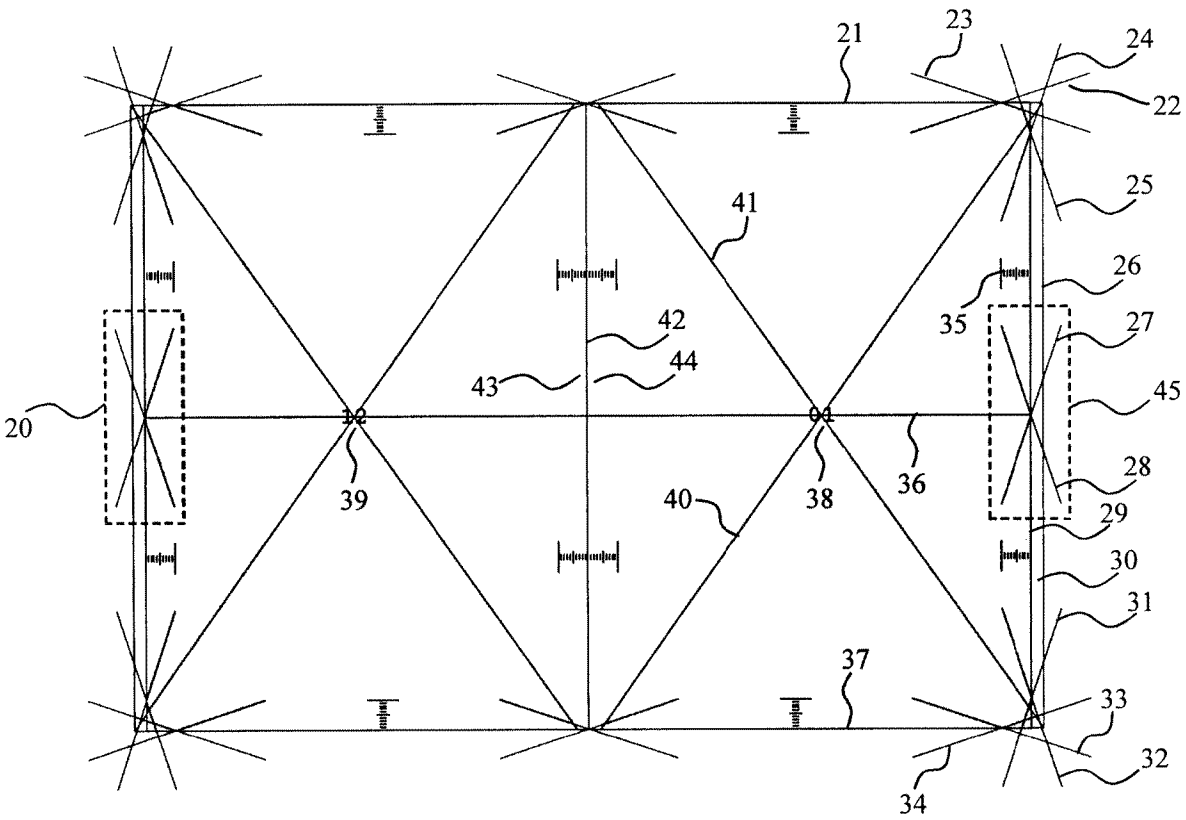
FIG. 2 shows a sheet of a booklet with marks according to the present invention.

FIG. 2 shows a sheet of a booklet with marks according to the present invention.

In order to make an A5 booklet, a plurality of sheets of an A4 format are printed upon with marks 22-25, 27-28, 31-34, according to the present invention. The presented sheet has a top edge 21, a bottom edge 37 and a face edge 26 which is intended to become part of a face of the booklet. The A4 sheets are planned to be folded according to spine center line 42 in order to form an A5 booklet. At the side of the face edge 26 the sheets are intended to be trimmed according to an intended trim line 29. Marks 24, 25, 27, 28, 31 and 32 intersect the intended trim line 29. Marks 22, 23 are intersecting the top edge 21. Marks 33, 34 are intersecting the bottom edge 37. Each of the marks 24, 25, 27, 28, 31 and 32 has an angle with the intended trim line 29 that is smaller than ½π radians. In FIG. 2, the angle of each of the marks 24, 25, 27, 28, 31 and 32 with the intended trim line 29 is even smaller than ¼π radians. This is advantageous to reach a magnifying effect with respect to measuring the deviation of the actual trimming action with an ideal trimming action which will be explained in FIG. 3. Trim deviation marks 24, 25 are near a first end of the intended trim line 29. Trim deviation marks 31, 32 are near a second end of the intended trim line 29. Trim deviation marks 27 and 28 are at the center of the intended trim line 29. A trim deviation area is located at both sides of the intended trim line 29. A right trim deviation area 30 is located at the right side of the intended trim line 29. A trim adjustment mark 35 is located at the intended trim line 29 for indicating a deviation in a distance unit like mm of the actual trim line from the intended trim line. The shown sheet has two leafs, a left leaf and a right leaf. A horizontal leaf center line 36 splits the right leaf into two parts, an upper part and a lower part. The horizontal leaf center line 36 also intersects the intended trim line 29 and the trim deviation marks 27 and 28 in a single point. The single point is the intended hit point. Each leaf has a number indication 38 and 39 according to the intended position of the leaf in the booklet as an end product. Note that the right leaf is the first leaf of the planned booklet. Leaf box diagonals 40 and 41 diagonalize the right leaf numbered "01". A spine area is defined at both sides of the spine center line 42, a left spine area 43 and a right spine area 44. The width of the spine area is amongst others defined by the number of A4 sheets which have to be folded to get the A5 booklet. It is noted that the marks according to the present invention may also be printed on the back side of the sheet. This is advantageous since the marks can then also be helpful in detecting deviations in the front-back registration of the printing system when printing double sided.

Figure 3:
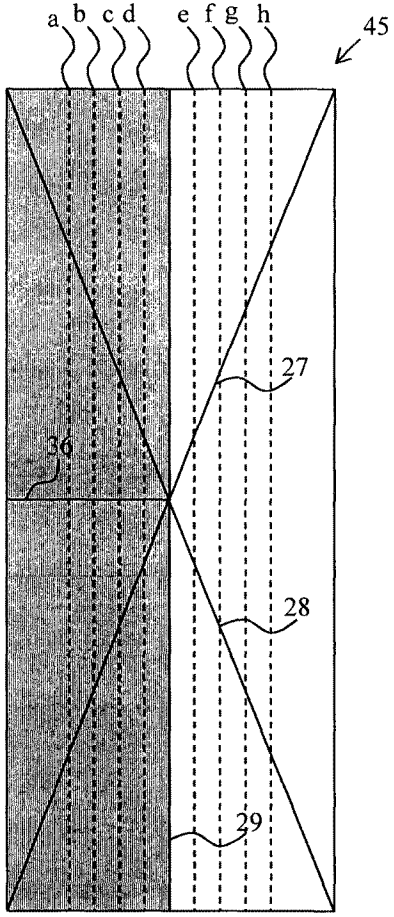
FIG. 3 shows a mark on a sheet of the booklet in FIG. 2.

FIG. 3 zooms in to the area 45 indicated in FIG. 2. FIG. 3 shows again the trim deviation marks 27 and 28, the intended trim line 29 and the horizontal leaf center line 36. FIG. 3 also shows potential actual trim edges a, b, c, d, e, f, g, h illustrated as dashed lines. Each of the dashed lines a, b, c, d, e, f, g, and h once intersects a first trim deviation line 27 and once intersects a second trim deviation line 28. Each of the dashed lines a, b, c, and d once intersects the horizontal leaf center line 36. Similar potential actual trim edges as potential actual trim edges a, b, c, d, e, f, g, and h may be envisioned in the area 20 on the opposite side of area 45. After folding the A4 sheet in half as to form two A5 sheets, those areas 45 and 20 will be on top of each other forming the new stack edge to be trimmed.

Figure 4:
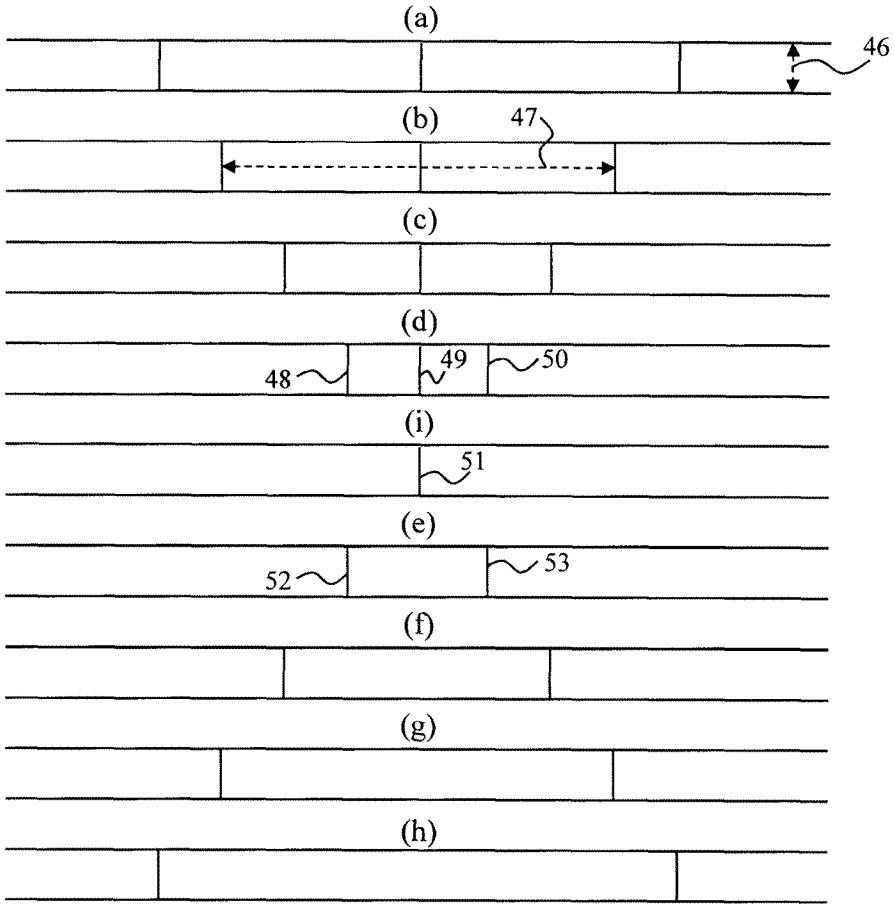
FIG. 4 shows a group of patterns on the edge of a stack of sheets according to the present invention.

FIGS. 4(*a*)-4(*i*) show patterns at the stack face edge of the finished A5 booklet. The stack face edge has a stack height indicated by the double sided arrow 46. A pattern of FIG. 4(*i*) corresponds to a situation in which the trimming action was extremely successful, namely that the actual trim edge of the sheet coincides with the intended trim line 29. The pattern shown in FIG. 4(*i*) shows only one line 51 in the stack height direction. The one line 51 is formed by printed points on each sheet of the stack. The printed points of the one line 51 corresponds the intersection point of the first trim deviation line 27 and the second trim deviation line 28 on each sheet, and corresponding trim deviation lines in area 20. Each of the printed points of the one line 51 is an intended and in this case also actual hit point according to the method of the invention.

FIG. 4(*e*) corresponds to a situation in which the trimming action was not completely successful, namely that the trimming was too little. The actual trim edge of the sheet coincides with the potential actual trim edge e shown in FIG. 3. The pattern in FIG. 4(*e*) shows two lines 52, 53 in the stack height direction. The first line 52 is formed by printed points on each sheet of the stack. The printed points of the first line 52 correspond to the intersection point of the second trim deviation line 28 with the potential actual trim edge e on each sheet. The second line 53 is also formed by printed points on each sheet of the stack. The printed points of the second line 53 correspond to the intersection point of the first trim deviation line 27 with the potential actual trim edge e on each sheet. Each of the printed points of the first line 52 and the second line 53 are actual hit points according to the method of the invention.

The distance between the first line 52 and the second line 53 is an indication for a degree of correctness of the finishing of the plurality of printed sheets in the stack. The trimming was too little, so the trim setting of the finishing module needs to be adjusted.

In this way the finishing module is calibrated.

FIGS. 4(*f*), 4(*g*) and 4(*h*) also correspond to situations in which the trimming action was not completely successful, namely the trimming was too little. The actual trim edge of the sheet coincides respectively with the potential actual trim edge f, g, and h as shown in FIG. 3. The patterns in FIGS. 4(*f*), 4(*g*) and 4(*h*) also show two lines in the stack height direction. Both lines are formed by printed points on each sheet of the stack. The printed points of a first line correspond to the intersection point of the second trim deviation line 28 with the respective potential actual trim edge f, g, and h on each sheet. The printed points of a second line correspond to the intersection point of the first trim deviation line 27 with the respective potential actual trim edge f, g, and h on each sheet. Each of the printed points of the first line and the second line are actual hit points according to the method of the invention.

The distance between the first line and the second line is increasing from FIG. 4(*e*) towards FIG. 4(*h*) via FIG. 4(*f*) and FIG. 4(*g*), and via other situations between each of FIGS. 4(*i*), 4(*e*), 4(*f*), 4(*g*) and 4(*h*), showing a continuous proportional indication for a degree of correctness of the finishing of the plurality of printed sheets in the stack. The trimming becomes worse from FIG. 4(*e*) towards FIG. 4(*h*). The trim setting of the finishing module needs to be adjusted.

FIG. 4(*d*) corresponds to a situation in which the trimming action was not completely successful, namely that the trimming was too much. The actual trim edge of the sheet coincides with the potential actual trim edge d shown in FIG. 3. The pattern in FIG. 4(*d*) shows three lines 48, 49, 50 in the stack height direction. The first line 48 is formed by printed points on each sheet of the stack. The printed points of the first line 48 correspond to the intersection point of the second trim deviation line 28 with the potential actual trim edge d on each sheet. The second line 50 is also formed by printed points on each sheet of the stack. The printed points of the second line 50 correspond to the intersection point of the first trim deviation line 27 with the potential actual trim edge d on each sheet. The third line 49, the middle line in the pattern, is also formed by printed points on each sheet of the stack. The printed points of the third line 49 correspond to the intersection point of the horizontal leaf center line 36 with the potential actual trim edge d on each sheet. Each of the printed points of the first line 48, the second line 50 and the third line 49 are actual hit points according to the method of the invention.

By showing three lines in the pattern when trimming is too much, the operator can distinguish on behalf of the pattern if trimming was too little or too much. Again the distance between the first line 48 and the second line 50 is an indication for a degree of correctness of the finishing of the plurality of printed sheets in the stack. The trimming was too much, so the trim setting of the finishing module needs to be adjusted. In this way the finishing module is calibrated.

FIGS. 4(*c*), 4(*b*) and 4(*a*) also correspond to situations in which the trimming action was not completely successful, namely the trimming was too much. The actual trim edge of the sheet coincides respectively with the potential actual trim edge c, b, a as shown in FIG. 3. The patterns in FIGS. 4(*c*), 4(*b*) and 4(*a*) also show three lines in the stack height direction. All three lines are formed by printed points on each sheet of the stack. The printed points of a first line correspond to the intersection point of the second trim deviation line 28 with the respective potential actual trim edge c, b, a on each sheet. The printed points of a second line correspond to the intersection point of the first trim deviation line 27 with the respective potential actual trim edge c, b, a on each sheet.

The printed points of a third line, the middle line in the pattern, correspond to the intersection point of the horizontal leaf center line 36 with the respective potential actual trim edge c, b, a on each sheet. Each of the printed points of the first line, the second line and the third line are actual hit points according to the method of the invention.

A distance between the first line and the second line, indicated by a double sided dashed arrow 47, is increasing from FIG. 4(*d*) towards FIG. 4(*a*) via FIG. 4(*c*) and FIG. 4(*b*), and via other not shown situations between FIGS. 4(*i*), 4(*d*), 4(*c*), 4(*b*) and 4(*a*), showing a continuous proportional indication for a degree of correctness of the finishing of the plurality of printed sheets in the stack. The trimming becomes worse from FIG. 4(*d*) towards FIG. 4(*a*). The trim setting of the finishing module needs to be adjusted.

FIGS. 2, 3 and 4 describe the case of trimming one face edge of the stack. However, any other edge may be envisioned to be cut or trimmed. Also, cutting a stack of sheets in two parts may be envisioned and the same marks may be used along an intended cutline.

Figure 5:
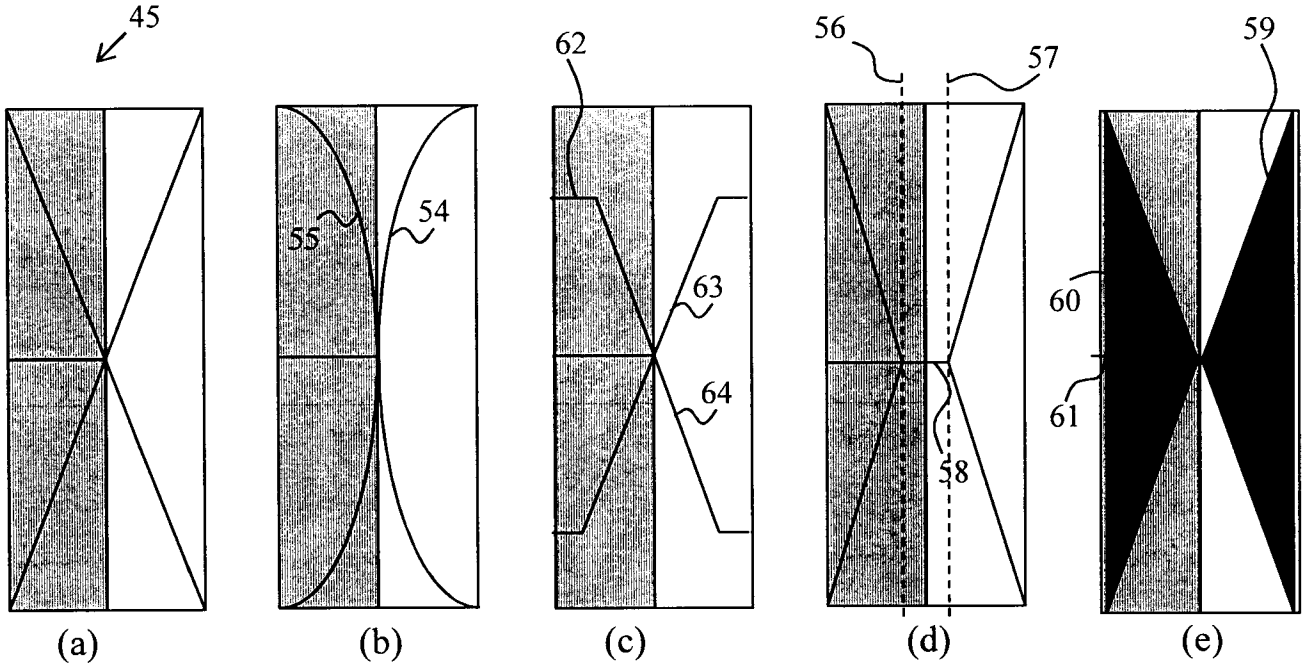
FIGS. 5 and 6 show examples of marks according to the present invention.
Figure 6:
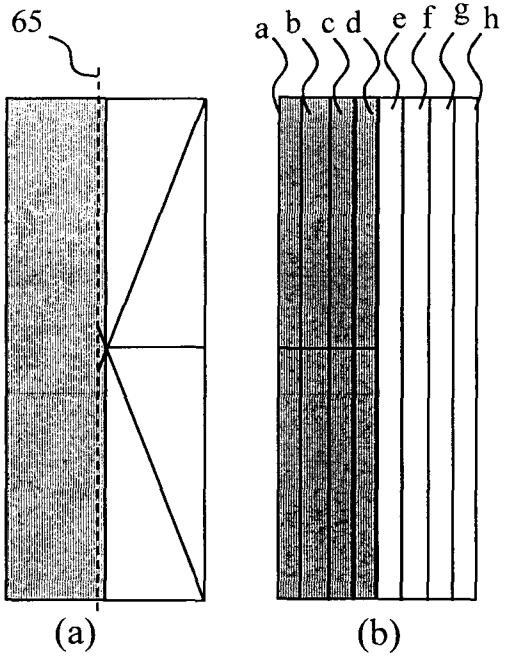

FIG. 5 and FIG. 6 show other embodiments of the marks according to the present invention. FIG. 5(*a*) shows again the area 45 according to FIG. 2 with the marks as indicated in FIG. 2.

FIG. 5(*b*) shows marks 54, 55 which have an elliptic form. The marks 54, 55 also lead to a pattern of two or three lines on the new actual stack edge. A distance between the two outer lines in the pattern is increasing when finishing gets worse. There is a maximum distance of the outer two lines in the pattern due to the elliptic curve of marks 54, 55.

FIG. 5(*c*) shows marks 63, 64 comprising two lines crossing the intended trim line and horizontal line segments 62. When the deviation from the intended trim line is worse enough the distance between two outer lines in the pattern remains constant due to the ending horizontal line segments 62 in the marks 63, 64.

FIG. 5(*d*) shows marks comprising a horizontal line segment 58 crossing the intended trim line. At each of the ends of the horizontal line segment 58 two lines start in a direction having an angle of less than $\frac{1}{4}\pi$ radians with the intended trim line. The horizontal line segment 58 is deemed to be a tolerance interval between two limits of deviations from the intended trim line indicated by vertical dashed lines 56, 57. Between the two limits the deviation from the intended trim line is tolerated. When the actual trimming is achieved between the two dashed lines 56, 57, only one single line is visible in the pattern on the face edge of the stack of sheets.

FIG. 5(*e*) shows a mark comprising two solid triangle 59, 60 and in one of the solid triangles (60), a horizontal line is left out of the triangle. According to this mark, the continuous proportional indication is determined by a size of each of an intersection between the mark and the new actual stack edge. The larger the intersection between the mark and the new actual stack edge, the larger the mistake in printing/finishing of the stack of sheets at the location on the new actual stack edge at which location the pattern emerges. The intersection between the mark and the new actual stack edge is a line segment, and the size of the intersection is determined to be the length of the line segment. The line segment is the set of actual hit points according to the method of the present invention. The intersection of the solid triangle 59, 60 with the new actual stack edge may be a point or a line segment. The length of the line segment indicates a degree of correctness of printing and/or finishing of the stack of sheets at the location at which the line segment emerges. The pattern formed by all the intersections on the new actual stack edge may be a solid rectangle, or a solid triangle, or any other compact solid geometrical object.

FIG. 6(*a*) shows a mark of two crossing lines wherein the crossing takes place at the intended trim edge. The line pieces of the crossing lines positioned left of the intended trim line are very small at cut off at a vertical dashed line 65 (not part of the mark). This is advantageous since these marks can also be used in combination with printing the actual content of a document on the same sheet. When trimming is done very accurate near the intended trim line, only small artifacts—the small line pieces, are visible on the printed sheet.

FIG. 6(*b*) shows a mark of colored bands a, b, c, d, e, f, g, h, each band having another color. According to this mark, the continuous proportional indication is a group of colors in the pattern which colors differ with the distance from actual trim edge of the stack to the intended trim line. A band of the mark may be red, orange, and green respectively, in order to indicate an incorrect, a risky and a correct trimming of the stack of sheets at the location at which the color emerges on the new actual stack edge. The colors of the bands may be symmetrically distributed perpendicular to the intended trim line. However, if too much trimming and too little trimming is to be distinguished from each other, other colors may be used on the left side of the intended trim line than on the right side of the intended trim line. Instead of bands near the intended trim line, a continuous part of a color spectrum may be envisioned to be printed on the place of and on both sides of the intended trim line.

FIGS. 4(*a*)-4(*h*) show patterns of straight lines in the direction of the stack height 46. However, the printing and/or finishing operations applied to the stack of sheets may also cause other patterns in the new actual stack edge.

Figure 7:
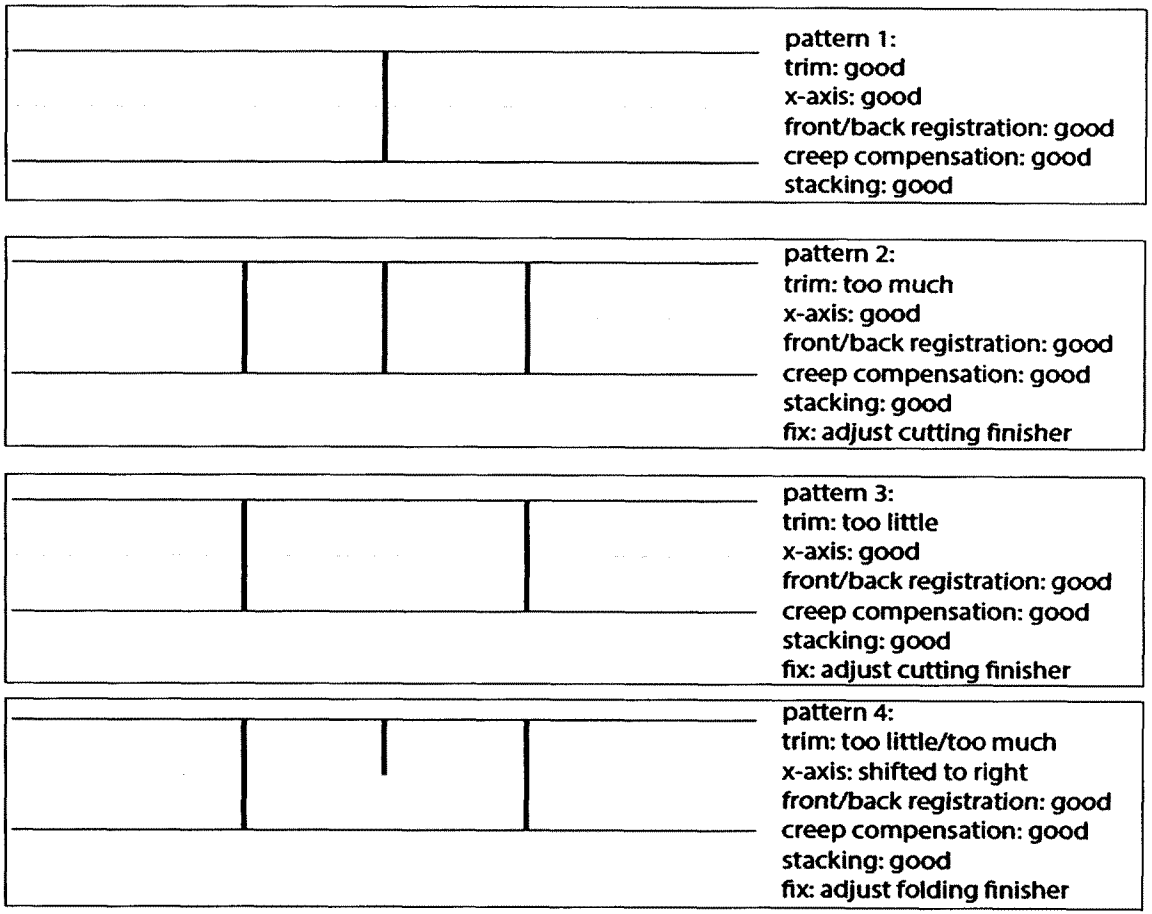
FIGS. 7 and 8 show examples of possible patterns visible on the edge of a stack of sheets.
Figure 8:
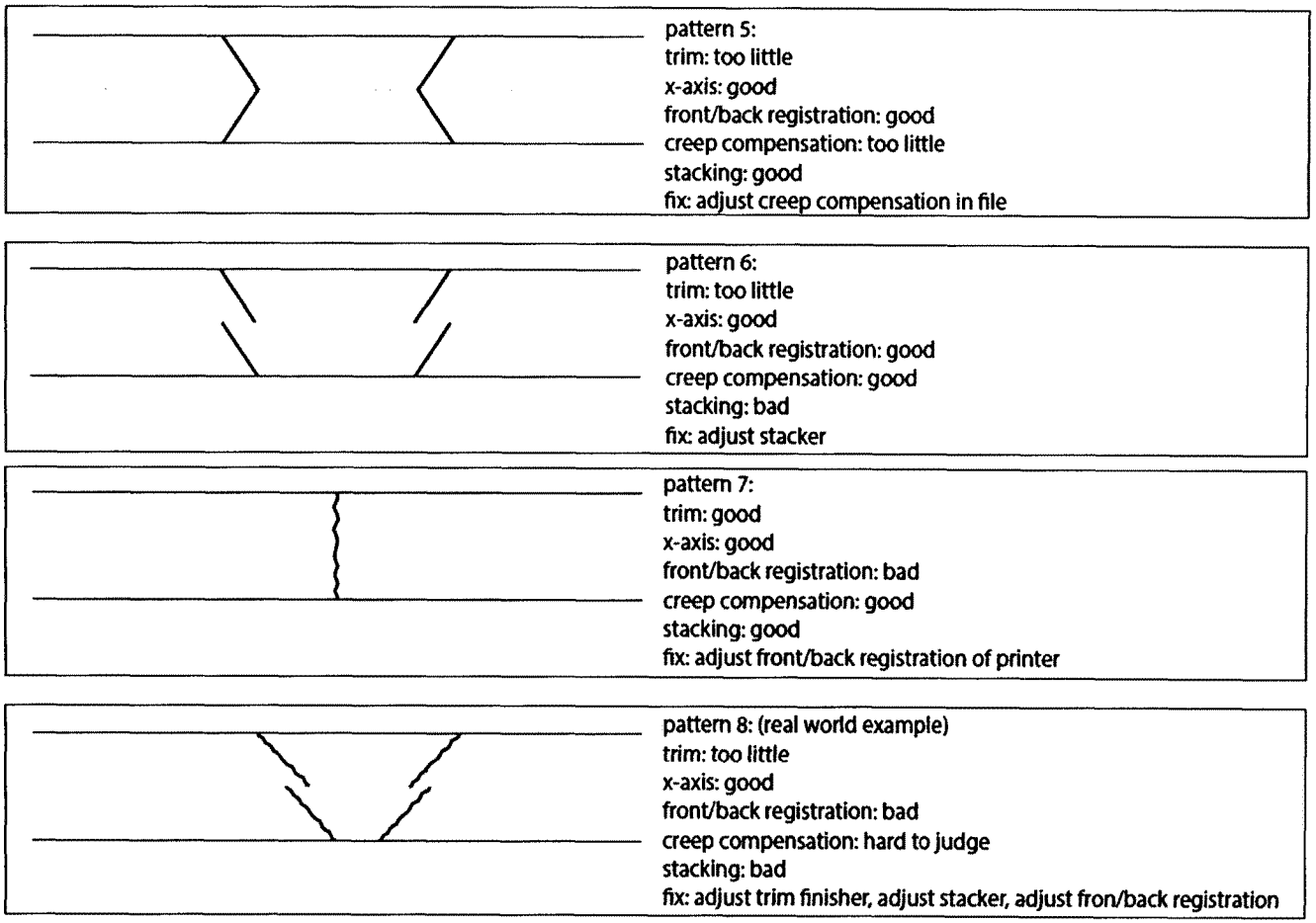
Figure 9A:
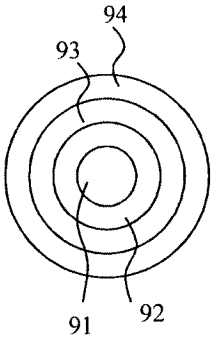
FIGS. 9(*a*)-9(*f*) show examples of marks for a punching or drilling operation.
Figure 9B:
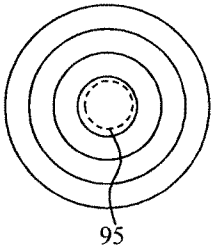
Figure 9C:
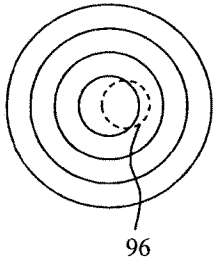
Figure 9D:
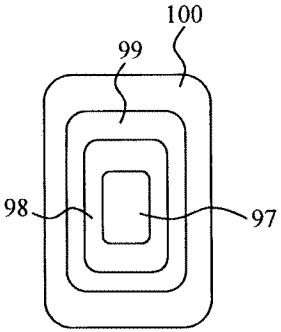
Figure 9E:
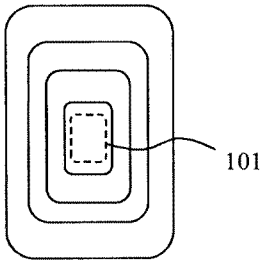
Figure 9F:
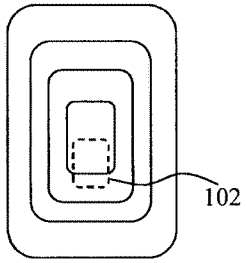

FIG. 7 and FIG. 8 show patterns which may emerge on the new face edge of the stack of sheets. The sheets have been printed by a print engine on both sides with marks according to FIG. 2, and stacked in a stacker. However, only printing on one side of the sheets may be envisioned. After printing the stack of sheets has been folded in halves by a folding finisher and trimmed by a trimming finisher in this example, but only trimming and/or cutting may also be envisioned. In FIG. 7 and FIG. 8, an x-axis is mentioned. The spine center line 42 according to FIG. 2 is part of this x-axis. The pattern emerges from actual hit points in the area 45 in FIG. 2 and from actual hit points in the area 20 in FIG. 2.

Pattern 1 shows one vertical line in the direction of the stack height. Pattern 1 emerges when trimming was correct, the spine center line was folded correctly, the front/back registration was correct, a creep compensation was correct and stacking was correct.

A creep appears because of the folding of the stack of sheets. No correcting action has to be executed by the operator.

Pattern 2 shows three vertical lines in the direction of the stack height. Pattern 2 emerges when trimming was too much, the spine center line was folded correctly, the front/back registration was correct, a creep compensation was correct and stacking was correct. A correcting action may be executed by the operator, namely adjusting of the trimming finisher.

Pattern 3 shows two vertical lines in the direction of the stack height. Pattern 3 emerges when trimming was too little, the spine center line was folded correctly, the front/back registration was correct, a creep compensation was correct and stacking was correct. A correcting action may be executed by the operator, namely adjusting of the trimming finisher.

Pattern 4 shows three vertical lines in the direction of the stack height. The middle vertical line only extends on the upper half of the stack. Pattern 4 emerges when trimming was too little in the lower half of the stack and too much in the upper half of the stack, the spine center line was shifted to the right, the front/back registration was correct, a creep compensation was correct and stacking was correct. A correcting action may be executed by the operator, namely adjusting of the folding finisher.

Pattern 5 shows two kinked vertical lines in the direction of the stack height. Pattern 5 emerges when trimming was too little, the spine center line was folded correctly, the front/back registration was correct, a creep compensation was too little and stacking was correct. Two correcting actions may be executed by the operator, namely the adjusting of the creep compensation in the image file corresponding to the document by means of an image preparing application and an adjustment of the trimming finisher.

Pattern 6 shows two slanted lines in the upper half of the stack and two slanted lines in the lower half of the stack height. Pattern 6 emerges when trimming was too little, the spine center line was folded correctly, the front/back registration was correct, a creep compensation was good and stacking was bad. A correcting action may to be executed by the operator, namely the adjusting of stacking in the stacker.

Pattern 7 shows one vertical tremulous line in the direction of the stack height. Pattern 7 emerges when trimming was correct, the spine center line was folded correctly, the front/back registration was bad, creep compensation was good and stacking was good. A correcting action may to be executed by the operator, namely the adjusting of the front/back registration of the print engine.

Pattern 8 shows two slanted tremulous lines in the upper half of the stack and two slanted tremulous lines in the lower half of the stack height. Pattern 8 emerges when trimming was too little, the spine center line was folded correctly, the front/back registration was bad, and stacking was bad. If there is a problem with the creep compensation is hard to judge because the pattern is already disturbed by the bad stacking. Correcting actions may be executed by the operator, namely adjusting of the trimming finisher, adjusting of the stacker, and adjusting the front/back registration of the print engine.

FIGS. 9(*a*)-9(*f*) show examples of marks used when drilling or punching a hole in a sheet. A mark shown in FIG. 9(*a*) consists of concentric circles around an intended location of a circular hole. The areas between the concentric circles may be colored with different colors. For example, an inner area 91 may be colored green to indicate that a hole in this area 91 is a correct punching. An area 92 may be colored yellow. An area 93 may be colored orange. An area 94 may be colored red to indicate that a hole in this area 94 is an incorrect punching.

FIG. 9(*b*) shows the same mark as in FIG. 9(*a*) and the new actual punch hole 95. The punch hole 95 is at a correct location in the green area 91. When looking inside the hole from a viewpoint above the stack of sheets, the circular wall of the punch hole 95 is completely green colored indicating a successful punch action.

FIG. 9(*c*) shows the same mark as in FIG. 9(*a*) and the new actual punch hole 96. The punch hole 96 is not at a correct location and is eccentric with respect to the concentric circles of the mark. The punch hole 96 hits the green area 91 and the yellow area 92. When looking inside the hole from a viewpoint above the stack of sheets, the circular wall of the punch hole 95 is partly green colored on the left part of the punch hole 96, and partly yellow colored on the right part of the punch hole 96. The visibility of more than one color on the circular wall of the punch hole is an indication of an incorrect punching action. Moreover, the visible colors indicate the severity of the incorrectness of the punching action. In case of incorrect punching or drilling adequate actions may be taken by an operator to adjust the punching or drilling device.

The marks shown in FIGS. 9(*a*)-9(*c*) may also be used to detect a too large hole with regard to a tolerated size of the hole specified by the inner area 91.

Concentric circles smaller than the inner area 91 may be added inside the inner area 91 in order to detect a hole that is too small. These additional concentric circles may have a color other than the green color of the inner area 91, or even color other than the yellow, orange and red color of the areas 92, 93, 94, respectively.

A mark shown in FIG. 9(*d*) comprises concentric rectangles around an intended location of a rectangular hole. The areas between the concentric rectangles may be colored with different colors. For example, an inner area 97 may be colored green to indicate that a hole in this area 97 is a correct punching. An area 98 may be colored yellow. An area 99 may be colored orange. An area 100 may be colored red to indicate that a hole in this area 100 is an incorrect punching.

FIG. 9(*e*) shows the same mark as in FIG. 9(*d*) and a new actual punch hole 101. The punch hole 101 is at a correct location in the green area 97. When looking inside the hole from a viewpoint above the stack of sheets, the rectangular wall of the punch hole 101 is completely green colored indicating a successful punch action.

FIG. 9(*f*) shows the same mark as in FIG. 9(*a*) and a new actual punch hole 102. The punch hole 102 is not at a correct location and is a-symmetric with respect to the concentric rectangles of the mark. The punch hole 102 hits the green area 97 and the yellow area 98. When looking inside the hole from a viewpoint above the stack of sheets, the rectangular wall of the punch hole 102 is partly green colored on an upper part of the punch hole 102 in FIG. 9(*f*), and partly yellow colored on a lower part of the punch hole 102 in FIG. 9(*f*). The visibility of more than one color on the wall of the punch hole is an indication of an incorrect punching action. Moreover, the visible colors indicate the severity of the incorrectness of the punching action. In case of incorrect punching or drilling, adequate actions may be taken by an operator to adjust the punching or drilling device.

The marks shown in FIGS. 9(*d*)-9(*f*) may also be used to detect a too large hole with regard to a tolerated size of the hole specified by the inner area 97.

Concentric rectangles smaller than the inner area 97 may be added inside the inner area 97 in order to detect a hole that is too small. These additional concentric rectangles may have a color other than the green color of the inner area 97, or even a color other than the yellow, orange and red color of the areas 98, 99, 100, respectively.

Areas with other colors than mentioned in the above description of FIGS. 9(*a*)-9(*f*) may be envisioned. Instead of areas around the punch hole a continuous part of a color spectrum may be envisioned to be printed on the place of, and around the intended location of a punch hole.

In a further embodiment of marks shown in FIGS. 2-5 and FIG. 6(*a*), the lines and/or curves of the marks are colored in such a way that the color indicates a degree of correctness of the finishing action and/or printing action.

In further embodiments, more than one finishing operation may be envisioned to be executed upon a stack of sheets. For each of the finishing actions marks may be printed on the plurality of sheets of the stack leading to multiple patterns. The multiple patterns may lead to adjustments to the finishing modules, the printing engine and/or the image file preparation.

Figure 10:
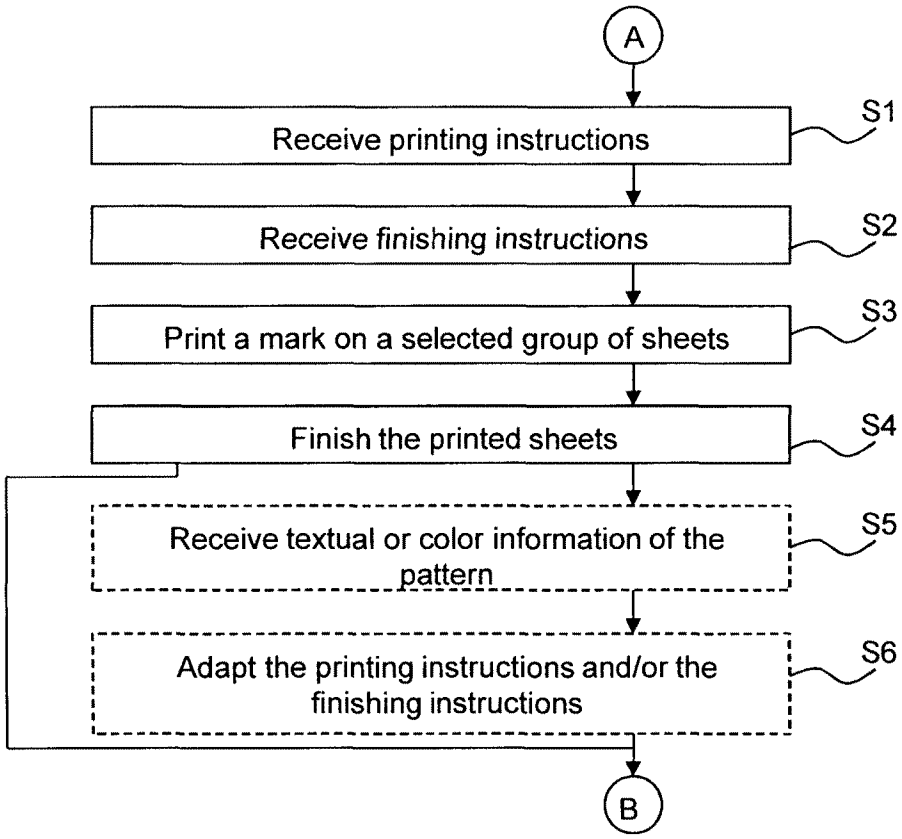
FIG. 10 shows a diagram of an embodiment of the method according to the present invention.

FIG. 10 shows a diagram of an embodiment of the method according to the invention. The method is suitable for automatic processing a plurality of sheets by means of printing and finishing on a printing system. A starting point A leads to a first step S1.

According to the first step S1, printing instructions are received by the printing system for printing the plurality of sheets. The printing instructions may concern the digital images to be printed and also the print job settings for printing.

According to a second step S2, finishing instructions are received for finishing the plurality of sheets after printing in order to form a stack of printed and finished sheets. The printing and finishing instructions may be combined in a submission of a print job to the printing system by a user or an operator. The first step S1 and the second step S2 may be combined into one step. The stack to be formed has a stack height depending amongst others on the kind of media to be printed upon. The finishing instructions comprising an instruction to create a new target stack edge extending in a direction of the stack height at an intended position on each of the plurality of sheets. A new target stack edge may be a new edge due to trimming an existing stack edge of the stack of sheets. A new target stack edge may be a new edge due to cutting an existing stack edge of the stack of sheets. A new target stack edge may be a new edge due to punching or drilling a hole in the stack of sheets in the stack height direction.

According to a third step S3, a mark is printed on each sheet of a group of sheets out of the plurality of sheets. The group of sheets may be selected by the user or operator, for example the top and bottom sheet or all sheets. Preferably all sheets are provided with the mark. The mark is intended to hit the new target stack edge in a group of at least one target hit point. The group of at least one target hit point may be one single point, two points, three points, a natural number of points or one or more line segments. The mark may comprise one or more line segments touching or crossing the new target stack edge, elliptic curves touching or crossing the new target stack edge, or solid two-dimensional objects touching or crossing the new target stack edge. The mark may also comprise solid color parts. The color of a color part expresses a degree of correctness of the printing and/or finishing.

According to a fourth step S4, the plurality of printed sheets is finished according to the finishing instructions creating a new actual stack edge. A plurality of actual hit points of the plurality of marks is visible on the new actual stack edge. Each of the plurality of actual hit point hits the new actual stack edge and corresponds to one hit point out of the group of at least one target hit point. The plurality of actual hit points form a pattern on the new actual stack edge. The pattern extends in a direction of the stack height. The pattern comprises a continuous proportional indication for a degree of correctness of the printing on the plurality of sheets and/or the finishing of the plurality of printed sheets as illustrated in FIG. 4, FIG. 7 and FIG. 8.

The method ends in an end point B.

According to an embodiment, the method further comprises the step of printing a line segment on each sheet of the group of sheets for each target hit point on the sheet, which line segment is part of the new target stack edge and comprises the corresponding target hit point.

According to a further embodiment, the method comprises two additional optional steps visualized in FIG. 10 with dashed boxes. In a fifth step S5, textual or color information is received by a user interface of the printing system. The textual or color information is read or observed from the pattern visible on the new actual stack edge of the stack of sheets by the operator. In a sixth step S6, the finishing instructions and/or the printing instructions are adapted in accordance with to the textual or color information in order to get a more correct end product when printing and finishing again.

According to an alternative embodiment, the method comprises the step of receiving a digital image of the pattern at an information interface of the printing system, and the method comprises a step of mapping the digital image to adaptations to the printing and/or finishing instructions in order to avoid an incorrect printing and/or finishing. The digital image may be a result of a photograph taken from the pattern visible on the new actual stack edge by a text or color identifying device. The mapping step may be processed by a control unit connected to the printing system.

Figure 11:
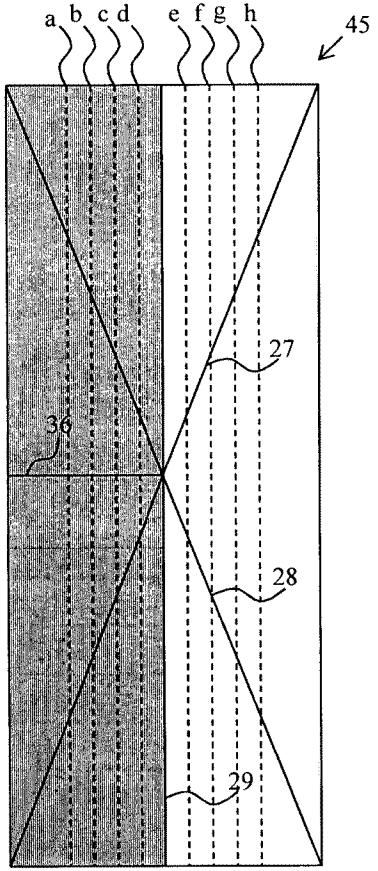

FIG. 11 is equal to FIG. 3 and zooms in to the area 45 indicated in FIG. 2. FIG. 11 shows again the trim deviation marks 27-28, the intended trim line 29 and the horizontal leaf center line 36. FIG. 11 also shows potential actual trim edges a, b, c, d, e, f, g, h illustrated as dashed lines. Each of the dashes lines a, b, c, d, e, f, g, h once intersects a first trim deviation line 27 and once intersects a second trim deviation line 28. Each of the dashed lines a, b, c, d once intersects the horizontal leaf center line 36.

Figure 12:
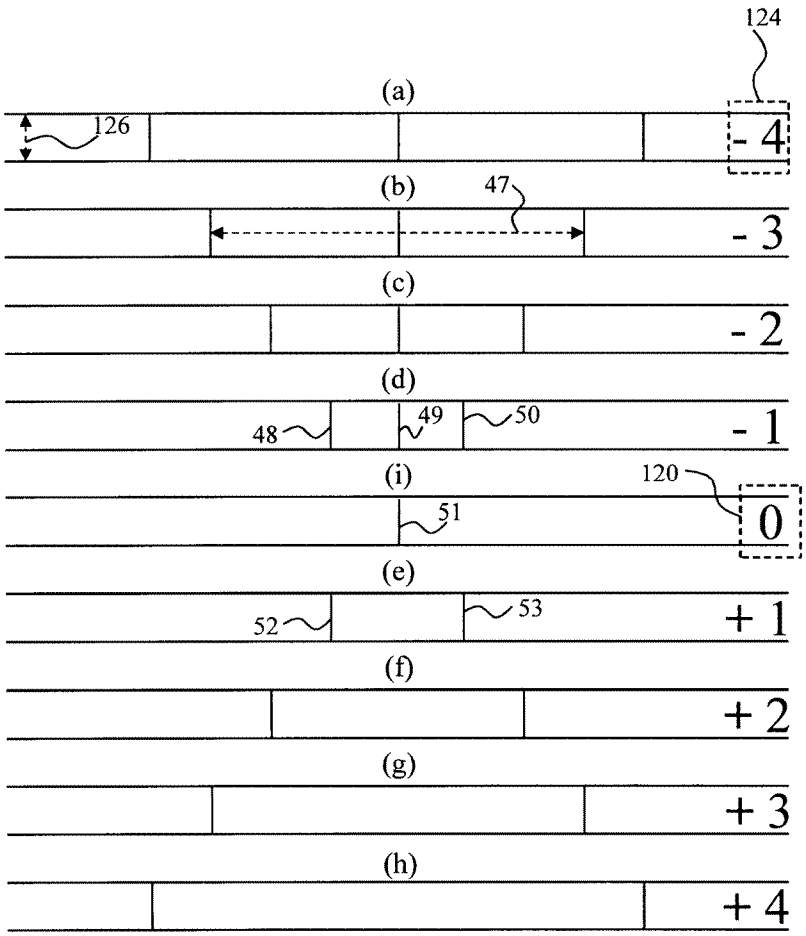
FIGS. 11 and 12 show another embodiment of the method according to the present invention.

FIGS. 12(*a*)-12(*i*) show patterns at the stack face edge of the finished A5 booklet. The stack face edge has a stack height indicated by the double sided arrow 126. The patterns in respective FIGS. 12(*a*)-12(*i*) represent the same situations as in respective FIGS. 4(*a*)-4(*i*). Additionally the mark on each sheet of a group of sheets selected from the plurality of sheets contains a part of a textual indication. The complete textual indication 120 becomes visible and readable in the pattern on the stack edge shown in FIGS. 12(*a*)-12(*i*). The textual indication in the pattern may be a numerical indication of the deviation from the intended trim line. For example, the numerical indication 120 for the situation in which the trimming action was extremely successful, namely that the actual trim edge of the sheet coincides with the intended trim line 29 as shown in FIG. 12(*i*), is the number zero (0). The number zero (0) shown in FIG. 12(*i*) is formed by printed points on each sheet of the stack. The printed points of the number zero (0) correspond to the intersection points of the actual stack edge with the part of the textual indication on each sheet. For example, the numerical indication 124 for the situation in which the trimming action was extremely too much as shown in FIG. 12(*a*), is the number minus four (−4). The location of the part of the mark being the part which is going to form the textual indication on the stack edge will proportionally vary per sheet in order to form the complete readable textual indication on the stack edge.

FIGS. 11 and 12 describe the case of trimming one face edge of the stack. However, any other edge may be envisioned to be cut or trimmed. Also cutting a stack of sheets in two parts may be envisioned and the same marks may be used along an intended cutline in order to form the patterns shown in FIG. 12.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A method for automatically processing a plurality of sheets, including printing and finishing with a printing system, the method comprising the steps of:

receiving printing instructions for printing the plurality of sheets;

receiving finishing instructions for finishing the plurality of sheets after printing in order to form a stack of printed and finished sheets, wherein the stack has a stack height and the finishing instructions comprises an instruction to create a new target stack edge extending in a direction of the stack height at an intended position on each of the plurality of sheets;

printing a mark on each sheet of a group of sheets out of the plurality of sheets, the mark intended to hit the new target stack edge in a group of at least one target hit point; and finishing the plurality of printed sheets according to the finishing instructions to create a new actual stack edge, wherein a plurality of actual hit points of the plurality of marks, each of the plurality of actual hit points hitting the new actual stack edge and corresponding to one hit point out of the group of at least one target hit point, form a pattern on the new actual stack edge, wherein the pattern extends in a direction of the stack height and comprises an indication for a degree of correctness of the printing on the plurality of sheets and/or the finishing of the plurality of printed sheets out of a collection of continuous proportional indications for degrees of correctness, wherein the mark intersects the new target stack edge in the plane of the sheet with an angle that is smaller than ½ π radians, wherein the pattern comprises textual information or color information of the degree of correctness of printing and/or finishing, and wherein the textual information is a numerical indication of a deviation from the new target stack edge.

2. The method according to claim 1, wherein the mark intersects the new target stack edge in the plane of the sheet with an angle that is smaller than ¼ π radians.

3. The method according to claim 1, wherein the continuous proportional indication is provided by a size of each of an intersection between the mark and the new actual stack edge.

4. The method according to claim 3, wherein the intersection is a line segment and the size of the intersection is determined to be the length of the line segment.

5. The method according to claim 3, wherein the intersection comprises one point or at least two points, wherein the size is determined to be zero if the intersection consists of one point, and wherein the size is determined to be the largest distance between the at least two points when the intersection comprises at least two points.

6. The method according to claim 3, wherein the mark comprises a first part and a second part, each part intersecting the new target stack edge, wherein the first part and the second part are divergent to each other and to a virtual auxiliary line between the first part and the second part, wherein the virtual auxiliary line is perpendicular to the new target stack edge, and wherein the continuous proportional indication is determined by a distance between an actual hit point of the first part and an actual hit point of the second part at each sheet printed with the mark.

7. The method according to claim 3, wherein the pattern consists of one line segment in the stack height direction of the new actual stack edge if the stack is correctly finished, and consists of at least two line segments in the height direction of the new actual stack edge if the stack is not correctly finished.

8. The method according to claim 1, further comprising the step of printing a line segment on each sheet of the group of sheets for each target hit point on the sheet, wherein the line segment is part of the new target stack edge and comprises the corresponding target hit point.

9. The method according to claim 1, wherein the finishing instruction is at least one out of a trimming instruction, a cutting instruction, a drilling instruction, a punching instruction and a folding instruction.

10. The method according to claim 1, wherein the finishing instruction comprises a folding instruction for the plurality of sheets along a fold line such that the new target stack edge is intended to be created opposite to the fold line after folding.

11. The method according to claim 1, wherein the mark is at least one out of a line segment, a circle, a curve, a circle segment, an ellipse, an ellipse segment, a rectangle, a rectangle corner, a triangle and a group of intersecting line segments.

12. The method according to claim 1, wherein the method further comprises a step of receiving the textual or color information by a user interface of the printing system, the textual information read from the stack of sheets, and adapting the printing instructions and/or the finishing instructions according to the textual information.

13. The method according to claim 1, further comprising the step of receiving a digital image of the pattern at an information interface of the printing system, and mapping the digital image to adaptations to the printing instructions and/or the finishing instructions in order to avoid an incorrect printing and/or finishing.

14. A non-transitory computer readable medium comprising computer executable program code configured to instruct at least one computer to perform the method according to claim 1.

15. A printing system for automatically printing and finishing a plurality of sheets, the printing system comprising:

a print engine;

a finishing module; and a control unit for receiving printing instructions for printing the plurality of sheets and for receiving finishing instructions for finishing the plurality of sheets after printing in order to form a stack of printed and finished sheets, the stack having a stack height, wherein the finishing instructions comprises an instruction to create a new target stack edge extending in a direction of the stack height at an intended position on each of the plurality of sheets, wherein the print engine is configured to print a mark on each sheet of a group of sheets out of the plurality of sheets, the mark intended to hit the new target stack edge in a group of at least one target hit point, wherein the finishing module being configured to finish the plurality of printed sheets according to the finishing instructions creating a new actual stack edge, wherein a plurality of actual hit points of the plurality of marks, each of the plurality of actual hit point hitting the new actual stack edge and corresponding to one hit point out of the group of at least one target hit point, form a pattern on the new actual stack edge, the pattern extending in a direction of the stack height and comprising an indication for a degree of correctness of the printing on the plurality of sheets and/or the finishing of the plurality of printed sheets out of a collection of continuous proportional indications for degrees of correctness, wherein the pattern comprises textual or color information of the degree of correctness of printing and/or finishing, and wherein the textual information is a numerical indication of a deviation from the new target stack edge.

16. The printing system according to claim 15, wherein the finishing module comprises at least one out of a trimming device, a cutting device, a drilling device, a punching device and a folding device.

* * * * *